United States Patent [19]

Waldvogel

[11] 4,309,960

[45] Jan. 12, 1982

[54] APPARATUS FOR SCRAPING EXCESS COATING SUBSTANCE OFF A RUNNING WEB

[75] Inventor: Hartmut Waldvogel, Heidenheim, Fed. Rep. of Germany

[73] Assignee: J. M. Voith GmbH, Fed. Rep. of Germany

[21] Appl. No.: 136,888

[22] Filed: Apr. 3, 1980

[30] Foreign Application Priority Data

Apr. 4, 1979 [DE] Fed. Rep. of Germany ..... 2913421

[51] Int. Cl.[3] ..... B05C 11/04

[52] U.S. Cl. ..... 118/665; 118/126

[58] Field of Search ..... 118/123, 126, 413, 665, 118/663; 427/358

[56] References Cited

U.S. PATENT DOCUMENTS

| | | | |
|---|---|---|---|
| 3,187,718 | 6/1965 | Coghill | 118/126 |
| 3,190,261 | 6/1965 | Ziffer | 118/665 |
| 3,442,684 | 5/1969 | Woodham et al. | 118/126 X |
| 3,882,817 | 5/1975 | Zink | 118/126 |
| 4,169,425 | 10/1979 | Wohrle | 118/126 X |
| 4,220,113 | 9/1980 | Wohlfeil | 118/126 |

FOREIGN PATENT DOCUMENTS 2435527 4/1979 Fed. Rep. of Germany .

*Primary Examiner*—John P. McIntosh

*Attorney, Agent, or Firm*—Ostrolenk, Faber, Gerb & Soffen

[57] ABSTRACT

An apparatus and process are disclosed for scraping excess coating substance from a running web by moving the web past a scraper blade that is oriented transversely to the running direction of the web. The blade is pressed against the web with a variable force. A motor automatically moves the blade to maintain the angle between the scraping surface thereof and the web approximately constant when the force varies, preferably by rotating the blade about an axis which is located near the scraping surface, is transverse to the running direction of the web and extends generally parallel to the blade direction of extension across the web. The amount of movement of the blade that is necessary to maintain the angle constant is preferably determined by monitoring either the thickness of the coating on the web or the degree to which the force on the blade deforms the blade from an undeformed shape. The automatic system can preferably be disabled to permit the blade angle to be set at a selected value manually.

23 Claims, 5 Drawing Figures

APPARATUS FOR SCRAPING EXCESS COATING SUBSTANCE OFF A RUNNING WEB

BACKGROUND OF THE INVENTION

The present invention relates to a process and an apparatus for scraping excess coating substance off a running web, such as a paper or cardboard web, of the kind employing a pivotable scraper blade to scrape off the excess material. Such a process and apparatus are used when it is desired to coat a web with a substance as evenly as possible. The web may run over a rotatable roller or over a fixed support device at the point where the excess coating substance is scraped off. If the web is coated on both sides, it may run between two symmetrically arranged scraping devices to remove the excess material from each side.

Apparatus of this kind is known, for example, from the Journal "Wochenblatt fuer Papierfabrikation", No. 16, (1978), pages 619 to 624 (published in English in the publication Voith-Press p 2371e), as well as from U.S. Pat. Nos. 3,131,092 and 3,882,817. In the known apparatus, there is a blade holder that is generally attached to a so-called scraper beam. Both the blade holder and the scraper beam extend transverse to the direction in which the web runs. The scraper blade is pressed against the paper web with adjustable force by means of an adjustable pressure device. During this process the scraper blade is deformed to a greater or lesser extent by the force exerted on it by the pressure device. Moreover, the blade is worn down by friction between it and the coating it scrapes off the web.

In the design described on page 622 of the cited Journal the scraper beam may be mounted for rotation as a unit with the blade holder around each of two different pivot axes. A first pivot axis is parallel to the blade and is located in the vicinity of the point of the blade, i.e. the end of the blade that is directed toward the web. By pivoting the scraper beam, the blade holder and the scraper blade around the first pivot axis located at or near the point of the blade, the scraper blade can be brought into different angular positions relative to the running web. This is necessary for adaptation to different types of webs, different coating substances and different coating thicknesses. The angle between the blade and the web, known as the blade angle, is determined by the angular position of the scraper beam about the first pivot axis and by the degree of deformation of the scraper blade caused by the force with which the blade is pressed against the web.

A second pivot axis is also provided, about which the scraper beam can be rotated between a rest position and an operative position. Both pivot axes are parallel to the surface of the running web and are perpendicular to the direction of the motion of the web.

The desired coating thickness can be obtained by setting the force exerted by the pressure device on the blade. If this force varies, the bowing of the blade changes and with it also the blade angle. In addition, the scraping surface of the blade, i.e. the oblique surface located at the point of the blade or that surface formed by wear during operation, no longer lies parallel to the surface of the web, as before. A disadvantage of the known apparatus is that after the force on the blade is altered, some time passes before the scraping surface of the blade is worn down parallel to the web again. Until the blade is worn down by friction in this manner, the coating will not be scraped to a uniform thickness.

To maintain the desired coating thickness as the blade scrapes the coating substance from the web after the force urging the blade against the web is changed, the blade angle must remain the same as before the force was changed. Although the machine operator could manually rotate the scraper beam and blade holder about the first pivot axis until the blade angle resumes its previous value, this procedure requires a high degree of skill and would takes the machine operator away from other tasks.

On the other hand, the apparatus known from the cited Journal reference has the advantage that the blade angle can be set at any required value over a very wide range. For example, it is possible to pivot the scraper beam and blade holder sufficiently far for the blade angle to be zero, while simultaneously urging the blade sufficiently strongly against the web. When the blade angle is zero, a side surface of the blade, rather than the oblique blade scraping surface, is pressed against the web. This reduces the amount of coating substance the blade scrapes off the web, making it possible to apply larger amounts of coating substance to the web and thus to obtain a greater coating thickness.

Finally, German Pat. No. 24 35 527 suggests locating the blade holder pivot axis between the blade point and the point of application of the force on the blade in such a way that the force can be varied as desired by pivoting the blade holder, without the blade angle being altered. As long as the blade angle remains constant, the scraping surface of the blade remains in a substantially unchanged position parallel to the direction of motion of the web. If the arrangement of this patent is employed, therefore, no wearing-down of the blade is required after the magnitude of the force is reset. With this arrangement it is not possible, however, to vary the blade angle by rotating the blade holder around its pivot axis. In particular, it is not possible to achieve the especially desirable operating condition in which the blade angle is zero, without providing a second pivot axis for rotation for the purpose of changing the blade angle. The additional axis would be located, as in the known apparatus first described above, in the vicinity of the point of the blade.

SUMMARY OF THE INVENTION

The object of the invention is to provide an apparatus and a process for scraping excess coating from a web in which the blade angle can be kept at least approximately constant when a selected operating condition is changed, e.g. when the force with which the blade is urged against the web is varied. A change in one operating condition should not be allowed to lessen the quality of the coating. The operating steps or control processes required to keep the blade angle constant should require no manual intervention. At the same time, however, it should be possible for the machine operator to adjust the blade angle to any required value.

According to the invention, means are provided for generating an adjustment signal which is a function of the force with which the scraper blade is urged against the web. The adjustment signal can be generated in various ways. For example, the adjustment signal may be derived from a control command signal which is generated by a regulating unit for the purpose of changing the force exerted on the scraper blade which force is, in turn, applied against the web. The magnitude of the control command signal indicates the amount by which the force on the blade is to be varied, and it is also a measure of the change that would, in the absence of the present invention, occur in the blade angle as a result of the change in the force on the blade. The magnitude of the adjustment signal, which corresponds to the magnitude of the control command signal, determines the angle through which the blade holder shall be rotated in order to compensate for the change in the force on the blade and to maintain the blade angle at least approximately constant at its original value.

A measuring device can be used to detect the change in the shape of the blade that occurs as the blade is bowed as a result of changes in the force applied on the blade. The measuring device generates an adjustment signal, which actuates a motor to rotate the blade holder through the angle necessary to maintain the blade angle constant.

The invention makes it possible to maintain the blade angle constant automatically when the force with which the scraper blade presses against the web is changed. The oblique scraping surface of the blade, ground away at the point of the blade, is automatically held parallel to the surface of the running web passing by. According to the invention, the rotation of the blade necessary to achieve this occurs simultaneously with the change in the force on the blade, or at least without any significant delay. Thus, any deviation in the blade angle from the value which prevailed before the change in the force on the blade is negligible.

A further advantage of the invention is that although the blade angle can be kept automatically constant, it is also possible for the blade angle to be adjusted arbitrarily by hand, by rotating the blade holder about the pivot axis located in the vicinity of the blade. It should be noted that according to the invention, only one pivot axis about which the blade holder can be rotated is necessary.

The scraping apparatus according to the invention thus has three important and basic advantages despite its simple construction.

When the scraper blade is set against the running web at a specific blade angle which is greater than zero, the blade angle can be held constant, irrespective of the force on the blade.

The blade angle can be adjusted at any time. In this case, the scraping surface of the blade will not be parallel to the surface of the web until a new scraping surface has been worn into the blade.

If required, the blade angle may at any time be set at zero.

Other objects and features of the invention will be apparent from the following description and the accompanying drawings.

BRIEF DESCRIPTION OF THE DRAWINGS

FIG. 2 shows a first operating position, before a change is made in the force on the blade.

FIG. 3 shows a second operating position, after the force on the blade has been altered and the blade holder has been repositioned to maintain the blade angle constant.

FIG. 4 shows a blade angle of zero.

DETAILED DESCRIPTION OF THE INVENTION

Figure 1:
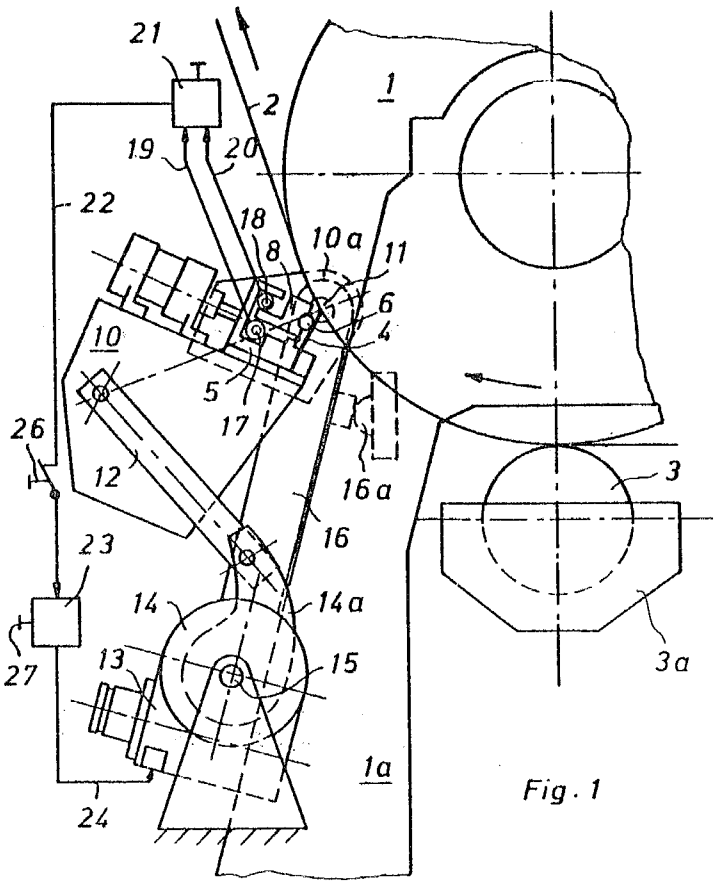
FIG. 1 is a schematic side view of a coating machine including the scraping apparatus of the invention.
Figure 2:
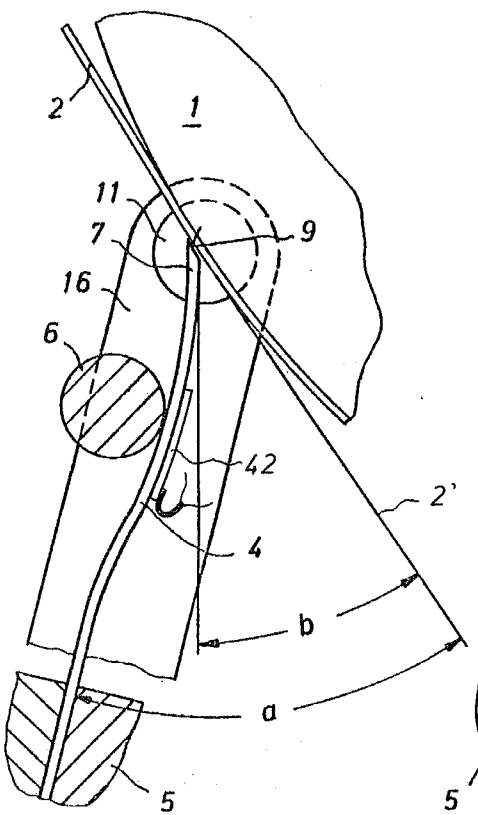

FIGS. 1 and 2 show a portion of a coating machine that includes the scraping apparatus of the invention. The coating machine includes a roller 1 rotatably mounted on a support 1*a*. Paper web 2 runs around roller 1. An application roller 3 applies a coating substance taken from reservoir 3*a* to the web 2.

Figure 3:
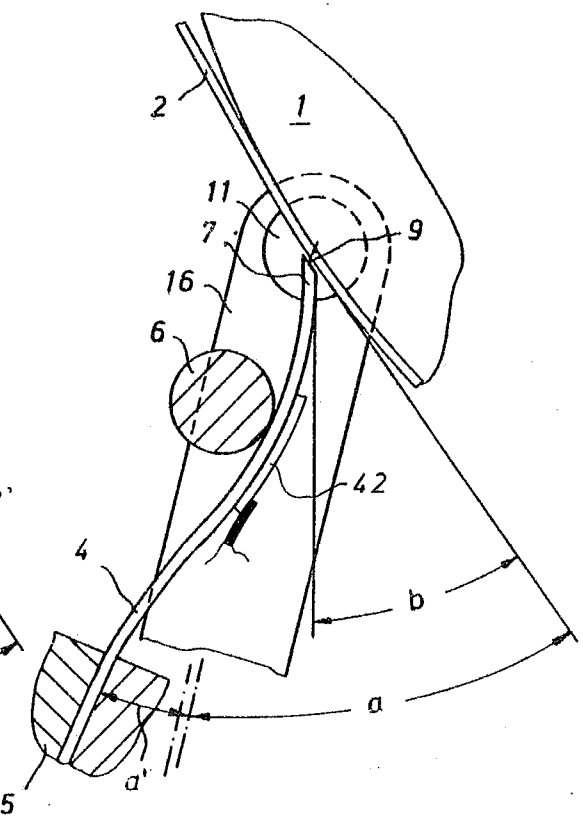

A scraper blade 4 scrapes off excess coating substance from the web 2. The blade 4 is held by a holder 5 therefor. A rod-shaped pressure element 6, mounted on the blade holder 5 by means of a pressure element holder 8, presses against one side of the scraper blade 4, which faces away from the roller 1, to urge the free end portion 7 of the blade, at which the point of the blade is located, into the coating substance which has been applied to the web 2. The point 7 of the blade 4 has an oblique scraping surface 9 inclined obliquely to the general direction of extension of the blade toward the web. After the blade 4 has been used for a certain time in a given position and orientation, the blade 4 is worn down by rubbing over the coating on the web 2 or the web 2 itself. This eventually changes the inclination of the scraping surface 9 of the blade so that it becomes parallel to the surface of the web 2, as shown in FIGS. 2 and 3.

The method of controlling the force that pressure member 6 exerts on the blade 4 in accordance with the invention will be described below.

The blade holder 5 is seated on a scraper beam 10. Both the blade holder 5 and the scraper beam 10 extend across the web 2 transverse to the direction of the motion of the web 2 past the blade holder 5, i.e. they extend perpendicular to the plane of FIG. 1. Each end of the scraper beam 10 is attached to a respective bearing bracket 10*a*. Each bearing bracket 10*a* is pivotably attached to one end of a respective pivot lever 16. The scraper beam 10 is thus suspended pivotally between the two pivot levers 16 for rotation about an axis 11 located at the upper end of the pivot levers 16. Axis 11 is substantially parallel to the scraping surface 9 of the blade 4, as the latter extends transversely across the web 2, and the axis 11 runs at least approximately along the point 7 of the blade 4. The scraper beam 10 is rotated about axis 11 by means of a motor 13. The motor 13 transmits the necessary force for rotating the scraper beam 10 by means of a gear unit 14, a lever 14*a* connected at one end to the gear unit 14 and a connecting rod 12 joining the second end of lever 14*a* to the scraper beam 10. The lower end of each pivot lever 16 is pivotally mounted for rotation about a second pivot axis 15. The motor 13 and the gear unit 14 rest on the second pivot axis 15 and can be pivoted about axis 15 together with the pivot levers 16. In FIG. 1, the pivot levers 16 and the scraper beam 10 with the blade holder 5 are shown rotated as far clockwise as they can be rotated about axis 15. In this operating position, the pivot levers 16 rest on respective stops 16*a* which are mounted on supports 1*a*. The pivot levers 16 can be rotated counterclockwise around the axis 15 into a rest position (not shown). In the rest position the scraper beam 10, the blade 4 and all the elements 4–14*a* are spaced from the web 2.

Figure 5:
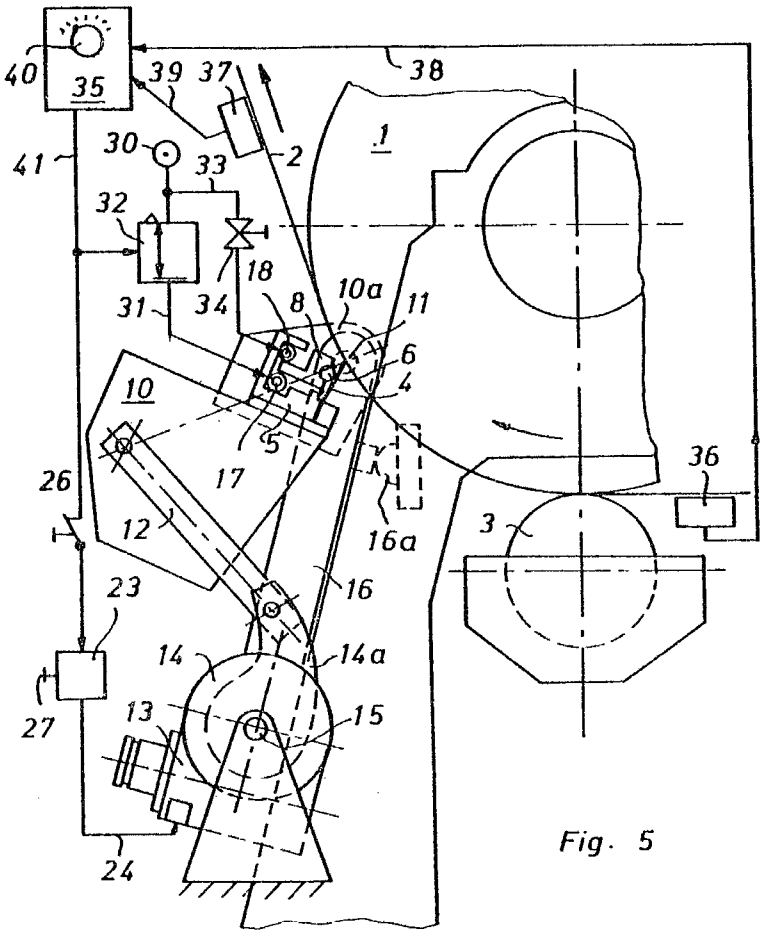
FIG. 5 shows the apparatus shown in FIG. 1, with a modified control device.

The force exerted on the scraper blade 4 by the pressure element 6 is determined and produced by the difference between the respective pressures in two pressurized gas hoses 17 and 18. The devices 30–34 for supplying the pressurized gas and for controlling the gas pressure in each of hoses 17 and 18 are shown in FIG. 5 and are explained below. A pressure difference measuring device 21 is connected to gas hoses 17 and 18 via measuring hoses 19 and 20, respectively. The pressure difference measuring device 21 supplies a signal corresponding to the instantaneous difference in gas pressure between gas hoses 17 and 18 to a signal processor 23 via a line 22.

If the pressure difference between hoses 17 and 18 varies for any reason, a corresponding variation in the force with which the blade 4 is urged against web 2 results. When this occurs, the signal processor 23 generates a corresponding adjustment signal determined by and representative of the magnitude of the variation in the pressure difference between hoses 17 and 18. The signal processor 23 sends the adjustment signal to the motor 13 via a line 24. Upon receiving the adjustment signal, the motor 13 pivots the scraper beam 10 and the blade holder 5 around the pivot axis 11 by such an amount that the scraping surface 9 of the blade 4, in the direction of motion of the web 2, remains parallel to the direction of the motion of the web 2 and the blade angle remains constant, despite the change in the force with which the blade 4 is urged against the web 2, and despite the resultant change in the shape of the blade 4.

In FIGS. 2 and 3, the process of keeping the blade angle constant by means of rotating the blade holder 5 about axis 11 is shown in greater detail. In FIG. 2, the pressure element 6 exerts a relatively small force on the blade 4 so that the blade 4 is bowed only slightly. The rotational position of the blade holder 5 with respect to pivot axis 11 is represented by the angle a, the angle between the portion of blade 4 that is secured in the blade holder 5 and the tangent 2' to the surface of the web 2 at the point at which the web 2 is scraped by blade 4. The blade angle is designated b. It is the angle between the blade and the web at the end portion of the blade. In a conventional coating apparatus not provided with the scraping apparatus of the invention, the blade angle b would be reduced as the force the pressure element 6 exerts on the blade 4 increases and as the blade 4 consequently bows more strongly. However, as can be seen in FIG. 3, the blade holder 5 is pivoted clockwise around the axis 11 through an angle a' simultaneously with the increase on the force urging the blade 4 against the web 2. The blade angle b is thereby maintained constant, and the scraping surface 9 of the blade remains parallel to the passing surface of the running web 2, as already mentioned.

Figure 4:
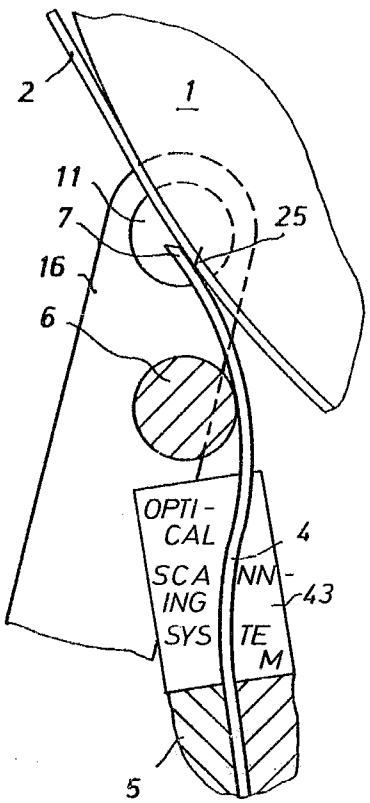
FIGS. 2 to 4 show the scraper blade of the apparatus in FIG. 1 on a larger scale, in various operating positions.

FIG. 4 shows the operating state in which the blade angle is zero. When the blade angle is zero, the scraping surface 9 of the blade 4 is no longer pressed against the web 2. Instead, a side surface 25 of the blade 4 is pressed against the web 2. To obtain a blade angle of zero, deactivation of the automatic controls 19–24 for keeping the scraping surface 9 of the blade 4 parallel to the direction of the motion of the web 2 is achieved by means of a switch 26 which is disposed in the line 22 (FIG. 1). The blade holder 5 is then rotated counterclockwise around the axis 11 until side surface 25 of the blade 4 rests against the web 2. The blade holder 5 is held in the proper position for a blade angle of zero by the gear unit 14 of the motor 13. Accordingly, no special locking device is required.

The embodiment shown in FIG. 5 differs from that shown in FIG. 1 in that it includes a modified control system for holding the blade angle b constant at a selected value. The hoses 17 and 18 are filled with pressurized gas supplied from a pressurized gas source 30. Gas from the pressurized gas source 30 flows through a line 31 to the hose 17 and through a line 33 to the hose 18, in which the pressure normally remains unchanged during operation. A pressure regulating valve 32 is provided in line 31. A throttle valve 34, which may be adjusted manually, is provided in line 33. The pressure regulating valve 32 is controlled by a regulating device 35 which is connected to the pressure regulating valve 32. The regulating device 35 regulates the coating thickness, i.e. the weight of the coating substance, to a constant value. For this purpose, measuring sensors 36 and 37 are located against the running web 2 at positions respectively upstream or in front of and downstream of or behind the scraping apparatus of the invention. Sensors 36 and 37 each measure the specific surface weight of the web 2 and supply respective measurement signals via lines 38 and 39 to the regulating device 35. The regulating device 35 monitors the difference between the two measurement signals, which is a measure of the thickness of the coating on the web 2. The difference between the measurement signals is compared with a preselected value which can be set by means of a rotating knob 40. When the regulating device 35 detects a deviation from the preselected value, it supplies a control command via line 41 to the pressure regulating valve 32. Responsive to the command signal from the regulating device 35, the pressure regulating valve 32 causes a corresponding change in the pressure of the gas supplied to gas hose 17 via line 31. The change in the pressure in gas hose 17 results in the exertion of a greater or reduced force on the blade 4 by pressure element 6, as required to produce a coating of the desired thickness on the web 2. At the same time the control command passes via line 41 to the signal processor 23 which, as described above, actuates the motor 13 to rotate the scraper beam 10 and the blade holder 5 around the axis 11 so that the blade angle b remains constant.

Other systems for monitoring the pressure of the blade 4 on the web 2, or the angle between scraping surface 9 of the blade 4 and the web 2, could be substituted for those described above. For example, a strain gauge 42 (see FIGS. 2 and 3) could be disposed adjacent the blade 4 to measure the strain in the blade 4, which varies with the pressure exerted on the blade 4 by pressure element 6. An optical scanning system 43 of a known type (see FIG. 4), for example comprising a light source and a plurality of photoelectric elements, could be used to measure the degree of bowing of the blade 4 resulting from changes in the force exerted on the blade 4 by the pressure element 6. The strain gauge 42 or optical scanning system 43 would then output a signal representative of the force on the blade 4, which signal would actuate the motor 13 via the signal processor 23, as in the embodiments shown in FIGS. 1 and 5.

The present invention may be embodied in other specific forms without departing from the spirit or essential attributes thereof, and, accordingly, reference should be made to the appended claims, rather than to the foregoing specification, as indicating the scope of the invention.

What is claimed is:

1. Apparatus for scraping excess coating substance off a running web, comprising:

a scraper blade extending across the web transverse to the running direction thereof and having a free end portion with a scraping surface;

means for running a web coated with a coating substance past the scraping surface for the scraping surface to scrape excess coating substance off the web;

pressure means for exerting a force on the blade for pressing the scraping surface against the web;

means for supporting the blade at a distance from the free end portion of the blade and for moving the blade, through movement of this means, for adjusting the blade angle between the blade, at the free end portion thereof, and the web; the moving means being adapted to rotate the blade about an axis of rotation transverse to the running direction of the web, and the rotation axis being located near the free end portion of the blade;

means for monitoring a selected parameter representative of the blade angle between the blade, in the vicinity of the free end portion, and the web; and control means connected with the moving means for causing the blade to be rotated about the axis of rotation by the moving means responsive to changes in the value of the parameter being monitored, to maintain the blade angle between the blade and the web approximately constant.

2. The apparatus of claim 1, wherein the means for moving the blade comprise a motor and connector means for transmitting force from the motor to the blade.

3. The apparatus of claim 2, wherein the monitoring means measures a parameter that is the thickness of the coating on the web, and wherein the control means further comprises means for actuating the motor for moving the blade whenever the measured thickness of the coating varies from a predetermined value.

4. The apparatus of claim 1, further comprising disconnect switch means for disabling the control means from causing movement of the blade.

5. The apparatus of claim 4, further comprising means for locking the blade in a selected position such that the blade angle is zero, when the disconnect switch means disables the control means.

6. The apparatus of claim 5, wherein the means for moving the blade comprises a motor, and wherein the means for locking the blade in place at a blade angle of zero comprises gear means cooperating with the motor and the blade to transmit force from the motor to the blade when the motor is actuated.

7. The apparatus of claim 1, wherein the pressure means comprise a pressure element for being pressed against the blade to press the blade against the web.

8. The apparatus of claim 7, wherein the blade has a support point at which it is supported, and wherein the pressure element presses against the blade at a location between the scraping surface of the blade and the support point of the blade.

9. The apparatus of claim 1, wherein the pressure means further comprises:

a pressure element holder; a pressure element secured to the pressure element holder and in contact with the blade for exerting a force thereon; and blade holder means to which the pressure element holder is attached.

10. The apparatus of claim 9, wherein the pressure element holder is attached for rotation relative to the blade holder means about a second axis of rotation parallel to the scraping surface of the blade and transverse to the running direction of the web, rotation of the pressure element holder about the second axis of rotation serving to vary the force with which the scraping surface of the blade presses against the web.

11. The apparatus of claim 10, wherein the monitoring means comprises first and second pressurized gas hoses cooperating with the blade holder means and the pressure element holder to cause rotation of the pressure element holder about the second axis of rotation when the gas pressure in the first gas hose varies; the monitoring means further comprising means for supplying pressurized gas to the pressurized gas hoses and for varying the pressure in the first pressurized gas hose.

12. The apparatus of claim 11, wherein the pressure element holder has a projecting tail portion, and wherein the blade holder means comprises an end portion defining a recess into which the tail portion of the pressure element holder projects; and wherein the first and second pressurized gas hoses are disposed side-by-side in the recess defined by the end portion of the blade holder means and are spaced apart in the recess by the tail portion of the pressure element holder, the diameter of the first pressurized gas hose varying responsive to variations in the gas pressure in the first hose, and variations in the diameter of the first pressurized gas hose serving to displace the tail portion of the pressure element holder and thereby to cause the pressure element holder to rotate about the second axis of rotation.

13. The apparatus of claim 12, wherein the means for supplying pressurized gas further comprises a pressure regulating valve for controlling the gas pressure in the first pressurized gas hose.

14. The apparatus of claim 13, wherein the control means further comprises a regulating device for controlling the pressure regulating valve.

15. The apparatus of claim 14, wherein the monitoring means further comprises means for measuring the thickness of the coating on the web, and wherein the thickness of the coating is the parameter being monitored by the monitoring means.

16. The apparatus of claim 14, wherein the regulating device generates a control signal to control the pressure regulating valve, thereby to control the force exerted on the blade by the pressure means, and wherein the control means further comprises signal processor means for generating an adjustment signal responsive to the control signal, the adjustment signal actuating the means for moving the blade to maintain the angle between the scraping surface of the blade and the web approximately constant.

17. The apparatus of claim 16, further comprising disconnect switch means for disabling the signal processor means, thereby to prevent movement of the blade responsive to changes in the parameter being monitored.

18. The apparatus of claim 14, wherein the regulating device controls the pressure regulating valve to cause the pressure means to exert a predetermined force on the blade.

19. The apparatus of claim 12, wherein the means for moving the blade comprises a motor, and wherein the monitoring means further comprises means for monitoring the difference in gas pressure between the first and second pressurized hoses and for actuating the motor to move the blade responsive to variations in the pressure difference from a preselected value.

20. The apparatus of any of claims 1, 12 or 16, wherein the monitoring means further comprises means for measuring the extent to which the shape of the blade is deformed from a relatively undeformed shape which it has when it does not press against the web, and wherein the parameter monitored by the monitoring means is the shape of the blade as it is deformed by the force exerted on it by the pressure means.

21. The apparatus of claim 20, wherein the monitoring means further comprises strain gauge means to monitor the shape of the blade as it is deformed by the force exerted on it by the pressure means.

22. The apparatus of claim 20, wherein the monitoring means further comprises optical scanning means for monitoring the shape of the blade as it is deformed by the force exerted on it by the pressure means.

23. The apparatus of either of claims 1 or 12, wherein the means for running the web past the blade comprises a roller around which the web is run.

* * * * *